US007004260B2

(12) United States Patent
Bosma et al.

(10) Patent No.: US 7,004,260 B2
(45) Date of Patent: Feb. 28, 2006

(54) METHOD OF SEALING AN ANNULUS

(75) Inventors: Martin Gerard Rene Bosma, Rijswijk (NL); Erik Kerst Cornelissen, Rijswijk (NL)

(73) Assignee: Shell Oil Company, Houston, TX (US)

( * ) Notice: Subject to any disclaimer, the term of this patent is extended or adjusted under 35 U.S.C. 154(b) by 195 days.

(21) Appl. No.: 10/484,517

(22) PCT Filed: Jul. 18, 2002

(86) PCT No.: PCT/EP02/08045

§ 371 (c)(1),
(2), (4) Date: Jan. 16, 2004

(87) PCT Pub. No.: WO03/008260

PCT Pub. Date: Jan. 30, 2003

(65) Prior Publication Data

US 2004/0182582 A1 Sep. 23, 2004

(30) Foreign Application Priority Data

Jul. 18, 2001 (EP) ..... 01306171

(51) Int. Cl.
*E21B 23/06* (2006.01)

(52) U.S. Cl. ..... 166/387; 166/384

(58) Field of Classification Search ..... None
See application file for complete search history.

(56) References Cited

U.S. PATENT DOCUMENTS

| | | | | |
|---|---|---|---|---|
| 2,103,482 A | 12/1937 | McCandless | ..... | 73/242 |
| 2,248,028 A | 7/1941 | Prutton | | |
| 2,294,294 A | 8/1942 | Grebe | | |
| 3,126,959 A | 3/1964 | Ortloff | | |
| 3,134,442 A | 5/1964 | Jennings | ..... | 166/207 |
| 3,179,168 A | 4/1965 | Vincent | | |
| 3,191,680 A | 6/1965 | Vincent | | |
| 3,297,092 A | 1/1967 | Jennings | ..... | 166/207 |
| 3,363,301 A | 1/1968 | Delaruelle et al. | ..... | 29/157 |

(Continued)

FOREIGN PATENT DOCUMENTS

EP 0460993 12/1991

(Continued)

OTHER PUBLICATIONS

Engineered Materials Handbook, Desk Edition, 2nd print (1998), ISBN 0-87170-283-5, "Thermosets", pp. 251-281.

(Continued)

*Primary Examiner*—Zakiya Walker

(57) ABSTRACT

A method is provided for activating a downhole system arranged in an annular space formed between a radially expandable tubular element extending into a borehole formed into an earth formation and a cylindrical wall surrounding the tubular element. The downhole system is arranged so as to be activated by movement of an annular movement device along the tubular element. The method involves arranging the annular moving device around the tubular element, the moving device having an inner diameter slightly larger than the outer diameter of the tubular element in its unexpanded shape, and gradually expanding a portion of the tubular element by moving an expander through the tubular element in the direction of the moving device, whereby a transition zone of the tubular element is defined between the expanded an unexpanded portions of the tubular element. Upon contact of the transition zone with the moving device, continuing movement of the expander through the tubular element causes the moving device to move in axial direction along the tubular element whereby the moving device activates the downhole system.

13 Claims, 6 Drawing Sheets

U.S. PATENT DOCUMENTS

| | | | | |
|---|---|---|---|---|
| 3,489,220 | A | 1/1970 | Kinley | 166/277 |
| 3,587,736 | A | 6/1971 | Brown | |
| 3,782,466 | A | 1/1974 | Lawson et al. | |
| 4,805,407 | A | 2/1989 | Buchanan | 60/517 |
| 5,202,194 | A | 4/1993 | VanBerg, Jr. | 429/13 |
| 5,337,823 | A | 8/1994 | Nobileau | 166/277 |
| 5,667,011 | A | 9/1997 | Gill et al. | 166/295 |
| 5,678,635 | A | 10/1997 | Dunlap et al. | |
| 5,718,288 | A | 2/1998 | Bertet et al. | 166/287 |
| 5,787,984 | A | 8/1998 | Mabile | 166/277 |
| 5,794,702 | A | 8/1998 | Nobileau | 166/380 |
| 5,833,001 | A | 11/1998 | Song et al. | 166/287 |
| 5,875,845 | A | 3/1999 | Chatterji et al. | 166/293 |
| 5,893,343 | A | 4/1999 | Rigazzi | 123/46 |
| 5,964,288 | A | 10/1999 | Leighton et al. | 166/207 |
| 6,012,522 | A | 1/2000 | Donnelly et al. | 166/276 |
| 6,181,110 | B1 | 1/2001 | Lampis | 322/3 |
| 6,376,925 | B1 | 4/2002 | Galich | 290/1 |
| 6,530,574 | B1 * | 3/2003 | Bailey et al. | 277/314 |
| 6,739,398 | B1 * | 5/2004 | Yokley et al. | 166/382 |

FOREIGN PATENT DOCUMENTS

| | | |
|---|---|---|
| EP | 0500303 | 8/1992 |
| EP | 0643794 | 11/1996 |
| EP | 0909008 | 4/1999 |
| WO | 94/09249 | 4/1994 |
| WO | 94/09250 | 4/1994 |
| WO | 94/09252 | 4/1994 |
| WO | 94/19574 | 9/1994 |
| WO | 95/19942 | 7/1995 |
| WO | 97/03489 | 1/1997 |
| WO | 99/02818 | 1/1999 |
| WO | 99/06670 | 2/1999 |
| WO | 99/23046 | 5/1999 |
| WO | 99/33763 | 7/1999 |

OTHER PUBLICATIONS

Specification for Line Pipe (API Specification 5L, 41st edition, Apr. 1, 1995) American Petroleum Institute, 1220 L St., Northwest Washington, DC 20005.

Specification for Casing and Tubing (API Specification 5CT 5th edition, Apr. 1, 1995) American Petroleum Institute, 1220 L St, Northwest Washington, DC 20005.

International Search Report dated Oct. 23, 2002.

* cited by examiner

METHOD OF SEALING AN ANNULUS

FIELD OF THE INVENTION

The present invention relates to a method of activating a downhole system arranged in an annular space formed between a tubular element extending into a borehole formed into an earth formation and a cylindrical wall surrounding the tubular element. The cylindrical can be, for example, the borehole wall or the wall of a casing extending into the borehole.

BACKGROUND OF THE INVENTION

For many wellbore applications, activation of such downhole system is required to perform a downhole process or to initiate such process. It has been tried to activate the downhole systems by means of hydraulic or electrical control lines extending from surface into the borehole. However, such control lines are vulnerable to damage and generally hamper construction of the well. For example, if the tubular element is a wellbore casing and electrical control lines are used at the outer surface of the casing, an electrical connector has to be applied at each connection of two adjacent casing sections.

SUMMARY OF THE INVENTION

In accordance with the invention there is provided a method of activating a downhole system arranged in an annular space formed between a radially expandable tubular element extending into a borehole formed into an earth formation and a cylindrical wall surrounding the tubular element, the downhole system being arranged so as to be activated by movement of an annular movement device along the tubular element, the method comprising:

arranging said annular moving device around the tubular element, the moving device having an inner diameter slightly larger than the outer diameter of the tubular element in its unexpanded shape;

gradually expanding a portion of the tubular element by moving an expander through the tubular element in the direction of the moving device, whereby a transition zone of the tubular element is defined between the expanded an unexpanded portions of the tubular element;

upon contact of the transition zone with the moving device, continuing movement of the expander through the tubular element so as to move the moving device in axial direction along the tubular element whereby the moving device activates the downhole system.

It is thus achieved that, upon expansion of the tubular element, the downhole system is triggered by the moving device to perform a downhole process. Such triggering occurs without the requirement for control lines extending from surface into the wellbore.

BRIEF DESCRIPTION OF THE DRAWINGS

The invention will be described hereinafter in more detail and by way of example with reference to the accompanying drawings in which.

In the Figures like reference numerals relate to like components.

DETAILED DESCRIPTION OF THE INVENTION

Figure 1A:
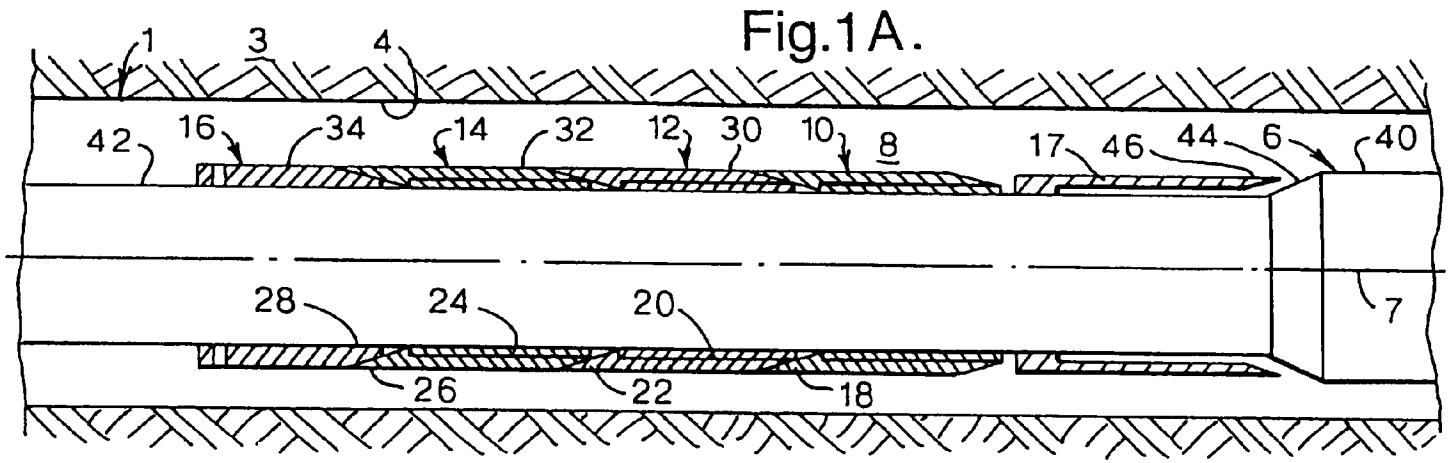
FIGS. 1A–1C schematically show a first embodiment of a borehole system for use in the method of the invention, during various stages of use thereof.

Referring to FIG. 1A there is shown a borehole 1 formed into an earth formation 3 whereby the borehole wall is indicated by reference numeral 4. A tubular member in the form of metal borehole casing 6 with longitudinal axis 7 extends substantially concentrically into the borehole 1. Thus, an annular space 8 is formed between said cylindrical members. It is to be understood that the borehole wall 4 does not need to be perfectly cylindrical as it generally is of irregular shape due to, for example, washouts which occur during the drilling process.

The casing 6 is provided with a downhole system in the form of a set of three annular seal elements 10, 12, 14 arranged around the casing 6 and being mutually displaced in axial direction thereof, and with a stop device in the form of annular stopper 16 fixedly connected to the casing 6 and arranged at one side of the set of sealing elements. Furthermore, the casing is provided with a moving device in the form of metal compression sleeve 17 arranged at the other side of the set of seal elements 10, 12, 14. The compression sleeve 17 is movable relative to the casing 6 in axial direction thereof.

The seal elements 10, 12, 14 are made of a flexible material such as rubber, and are optionally strengthened in axial direction by axially extending reinforcement bars (not shown) embedded in the flexible material. Seal element 10 has a tapered edge 18 adjacent seal element 12, seal element 12 has a tapered edge 20 adjacent seal element 10 and a tapered edge 22 adjacent seal element 14, and seal element 14 has a tapered edge 24 adjacent seal element 12 and a tapered edge 26 adjacent stopper 16. The stopper 16 has a tapered edge 28 adjacent seal element 14. The tapered edges 18, 20 are oriented such that seal element 10 is induced to slide along radial outer surface 30 of seal element 12 when seal element 10 is pushed in the direction of seal element 12. Similarly, the tapered edges 22, 24 are oriented such that seal element 12 is induced to slide along radial outer surface 32 of seal element 14 when seal element 12 is pushed in the direction of seal element 14. Furthermore, the tapered edges 26, 28 are oriented such that seal element 14 is induced to slide along radial outer surface 34 of stopper 16 when seal element 14 is pushed in the direction of stopper 16.

The casing 6 has a radially expanded portion 40, a radially unexpanded portion 42, and a transition portion 44 located between the expanded and unexpanded portions 40, 42 and a having a diameter varying from the unexpanded diameter to the expanded diameter.

The stopper 16, the seal elements 10, 12, 14, and the compression sleeve 17 are all arranged around the unexpanded portion 42 of the casing whereby the compression sleeve 17 is arranged adjacent the transition portion 44 of the casing.

The compression sleeve 17 has an edge 46 adjacent the expanded portion 40 of the casing 6, which is provided with an axial bearing which ensures low friction between the edge and the transition portion 44 of the casing 6. The bearing can be, for example, a bronze or Teflon (Trade Mark) bushing, a thrust bearing (e.g. set of bearing balls regularly spaced along the circumference of the edge), or a hydrostatic bearing.

Figure 2A:
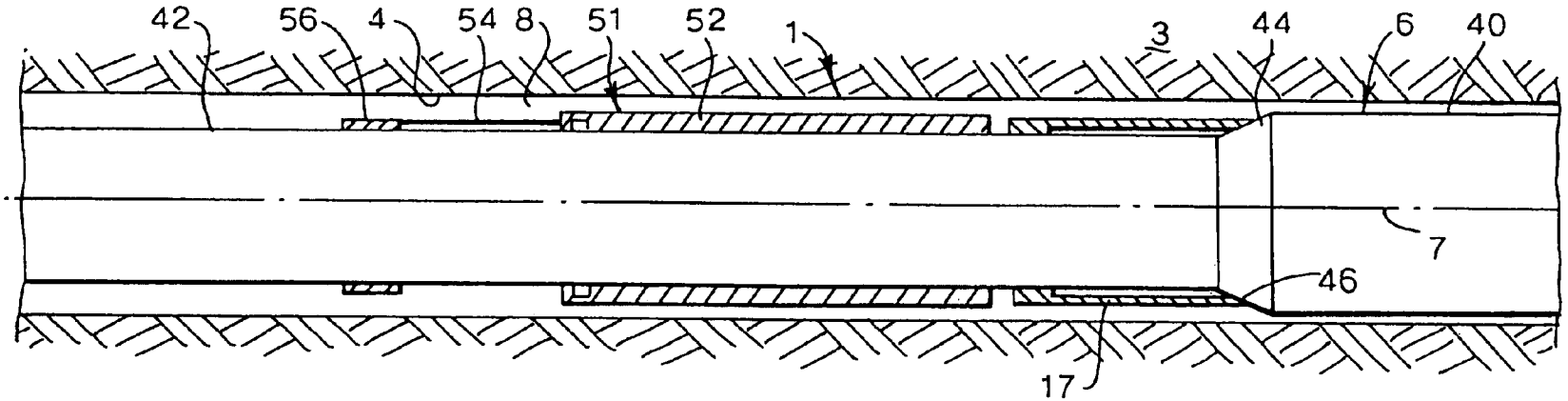
FIGS. 2A–2B schematically show a second embodiment of a borehole system for use in the method of the invention, during various stages of use thereof.
Figure 2B:
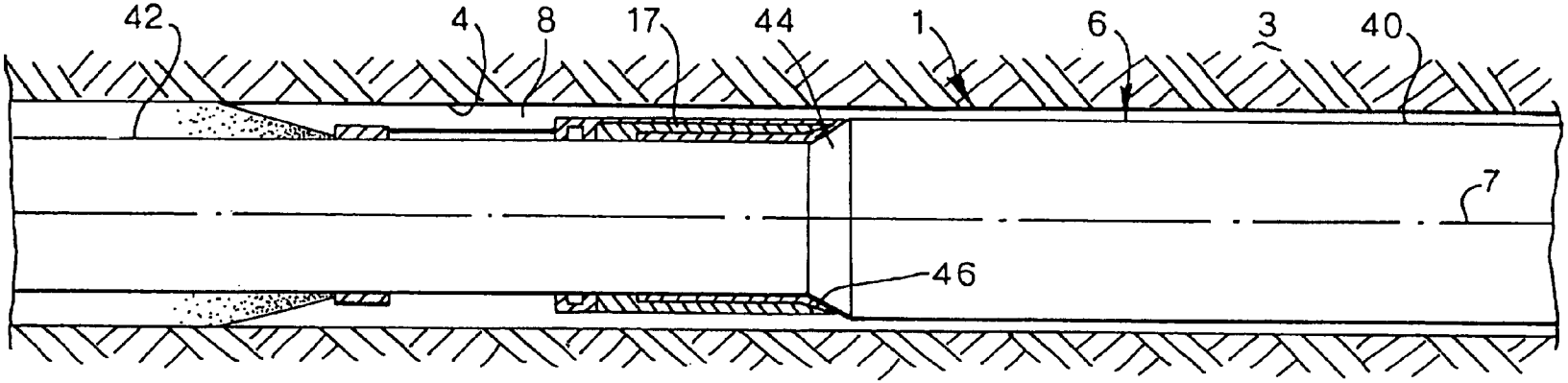

Referring to FIGS. 2A, 2B there is shown a downhole system in the form of an annular injection device 51 arranged around the casing 6, which injection device 51 upon activation thereof injects a selected fluid into the annular space 8. The injection device includes an annular pump 52 arranged to pump the selected fluid via a conduit 54 and a plurality of circumferentially spaced annular nozzles 56 into the annular space 8 upon activation by the compression sleeve 17. The selected fluid is, for example, a chemical activator for hardening a body of cement slurry (not shown) present in the annular space 8, or a catalyst or chemical for triggering a chemical reaction of a body of resin (not shown) present in the annular space 8. Several said annular injection devices 51 are arranged at selected mutual axial distances along the casing 6, however for the sake of simplicity only one injection device 51 is shown.

Figure 3A:
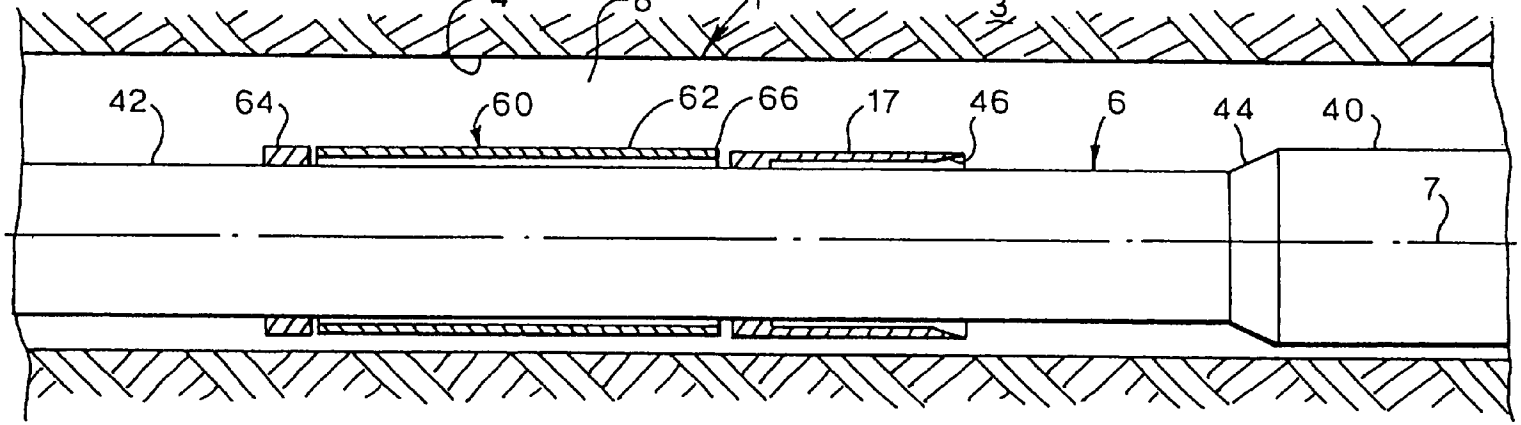
FIGS. 3A–3C schematically show a third embodiment of a borehole system for use in the method of the invention, during various stages of use thereof.
Figure 3B:
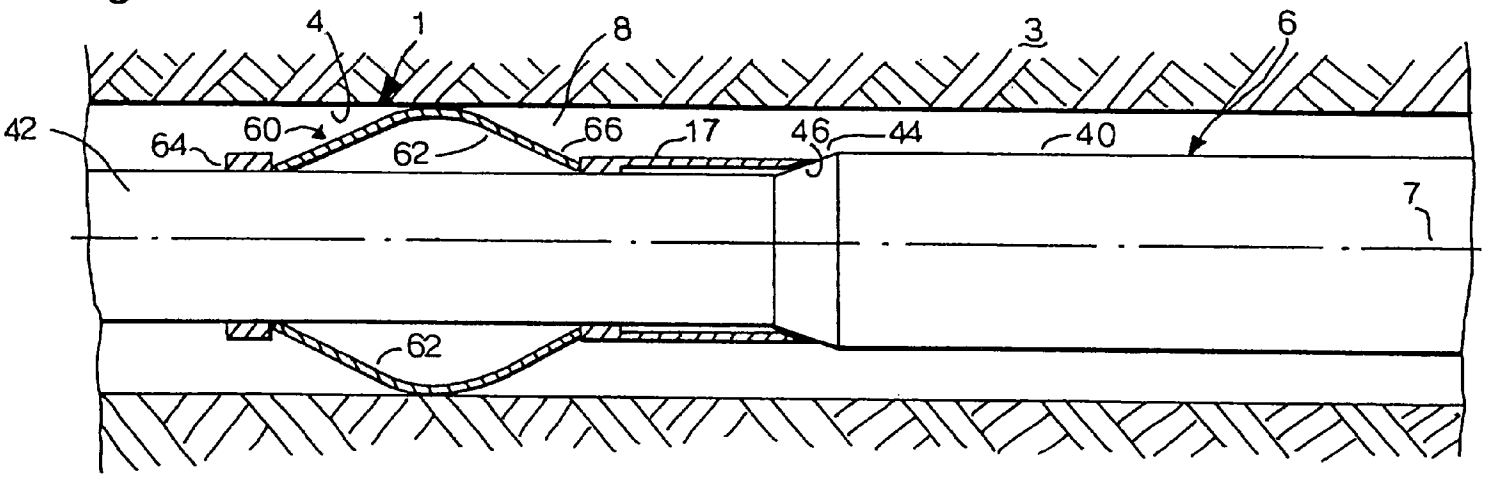
Figure 3C:
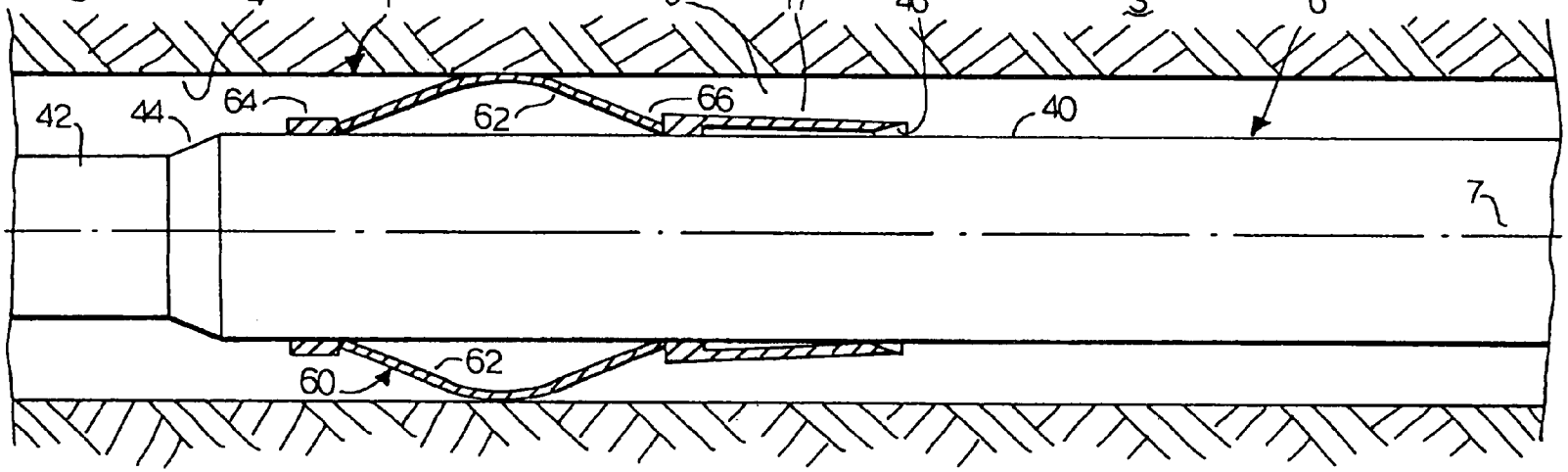

Referring to FIGS. 3A–3C there is shown a downhole system in the form of a casing centraliser 60 arranged around the casing 6, which centraliser is largely similar to a conventional bow centraliser. The centraliser 60 has spring arms 62 which bend upon axial compression of the centraliser 60 and thereby expand radially against the borehole wall. The centraliser 60 has an end part 64 (remote from the compression sleeve 17) which is fixedly connected to the casing 6, and an end part 66 (adjacent the compression sleeve 17) which axially slideable along the casing 6.

Figure 4A:
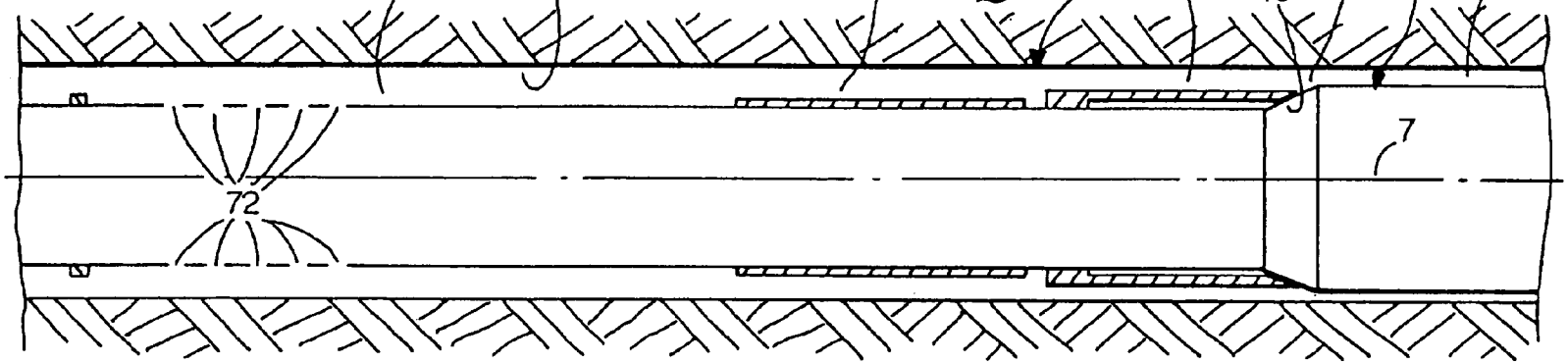
FIGS. 4A–4C schematically show a fourth embodiment of a borehole system for use in the method of the invention, during various stages of use thereof.
Figure 4B:
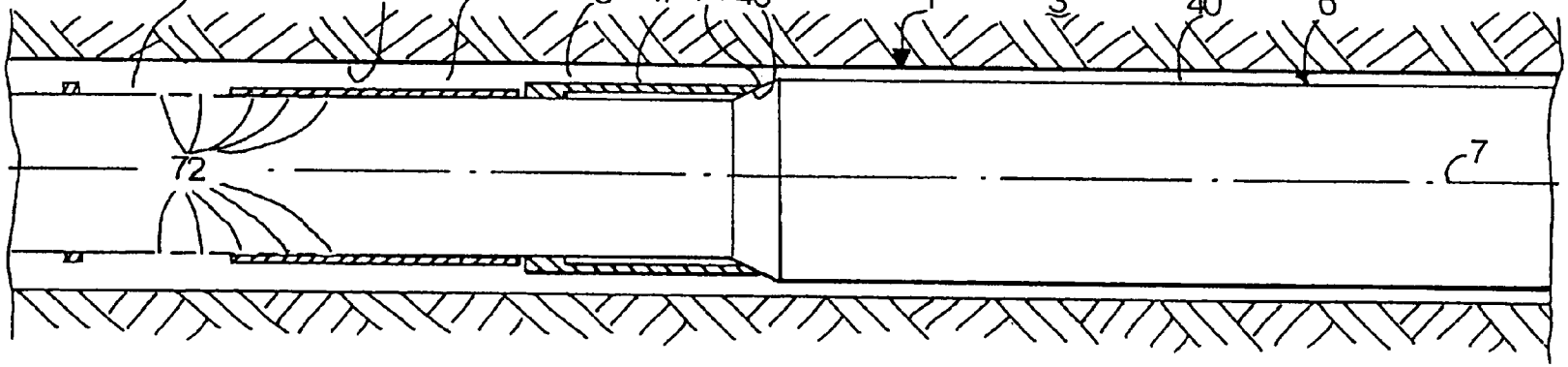
Figure 4C:
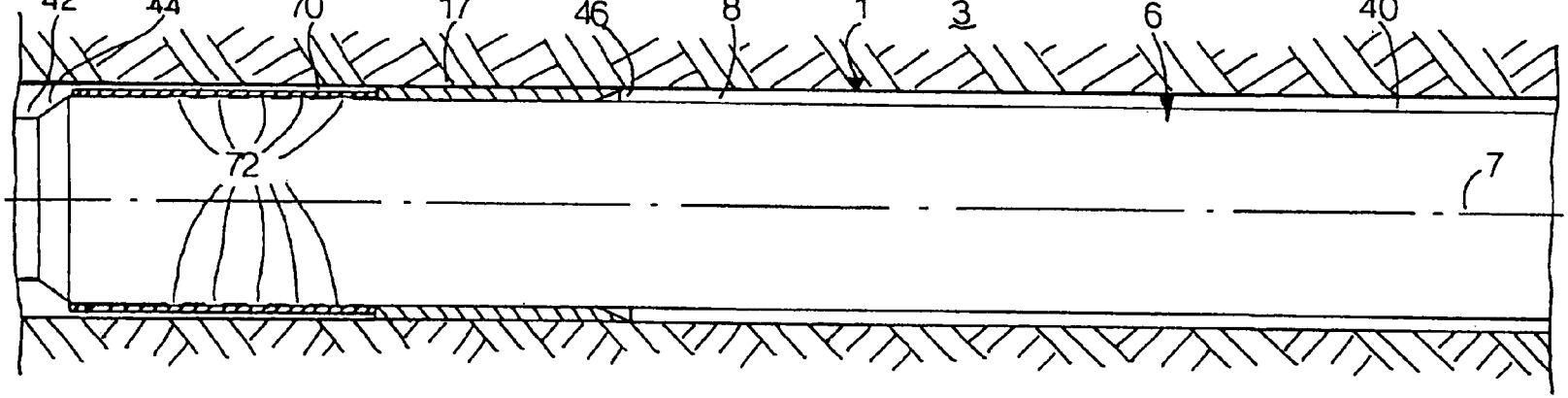

Referring to FIGS. 4A–4C there is shown a downhole system which includes a slideable sleeve 70 arranged around the casing 6, the sleeve 70 having an inner diameter slightly larger than the outer diameter of the casing 6. The wall of casing 6 is provided with a number of openings 72 which provide fluid communication between the interior and the exterior of the casing 6.

During normal operation of the first embodiment, the casing 6 is installed in the borehole 1 with the stopper 16, the seal elements 10, 12, 14, and the compression sleeve 17 arranged around the casing 6 as shown in FIG. 1A. An expander (not shown) is then pushed or pulled through the casing 6 to radially expand the casing 6 and thereby to form the initial expanded portion 40 thereof. A suitable expander is, for example, a conical expander or a conical expander provided with rollers along the contact surface with the casing. By the expansion process the casing 6 is plastically deformed.

Figure 1B:
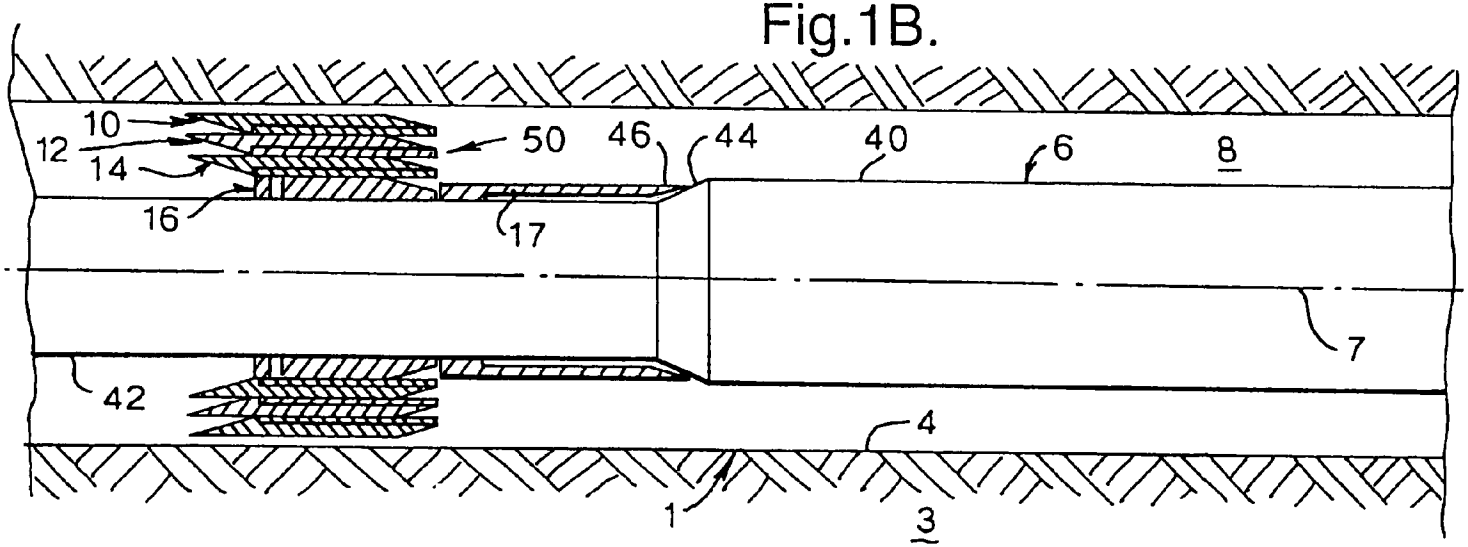

Referring further to FIG. 1B, the expander is moved through the casing 1 in the direction of stopper 16 thereby increasing the length of the expanded portion 40 and moving the transition portion 44 in the direction of stopper 16. Upon contact of the transition portion 44 with the edge 46 of the compression sleeve 17, continued movement of the transition portion 44 induces the compression sleeve to move in the direction of stopper 16. The compression sleeve 17 thereby induces seal element 10 to move against seal element 12 and subsequently to slide along the radial outer surface 30 thereof. When seal element 10 becomes fully arranged around seal element 12, continued movement of the transition portion 44 induces the compression sleeve 17 to move seal element 12 against seal element 14 and subsequently to slide along the radial outer surface 32 thereof. When seal elements 10, 12 become fully arranged around seal element 14, continued movement of the transition portion 44 induces the compression sleeve 17 to move seal element 14 against stopper 16 and subsequently to slide along the radial outer surface 34 thereof. A set 50 of radially stacked seal elements has thus been formed.

Figure 1C:
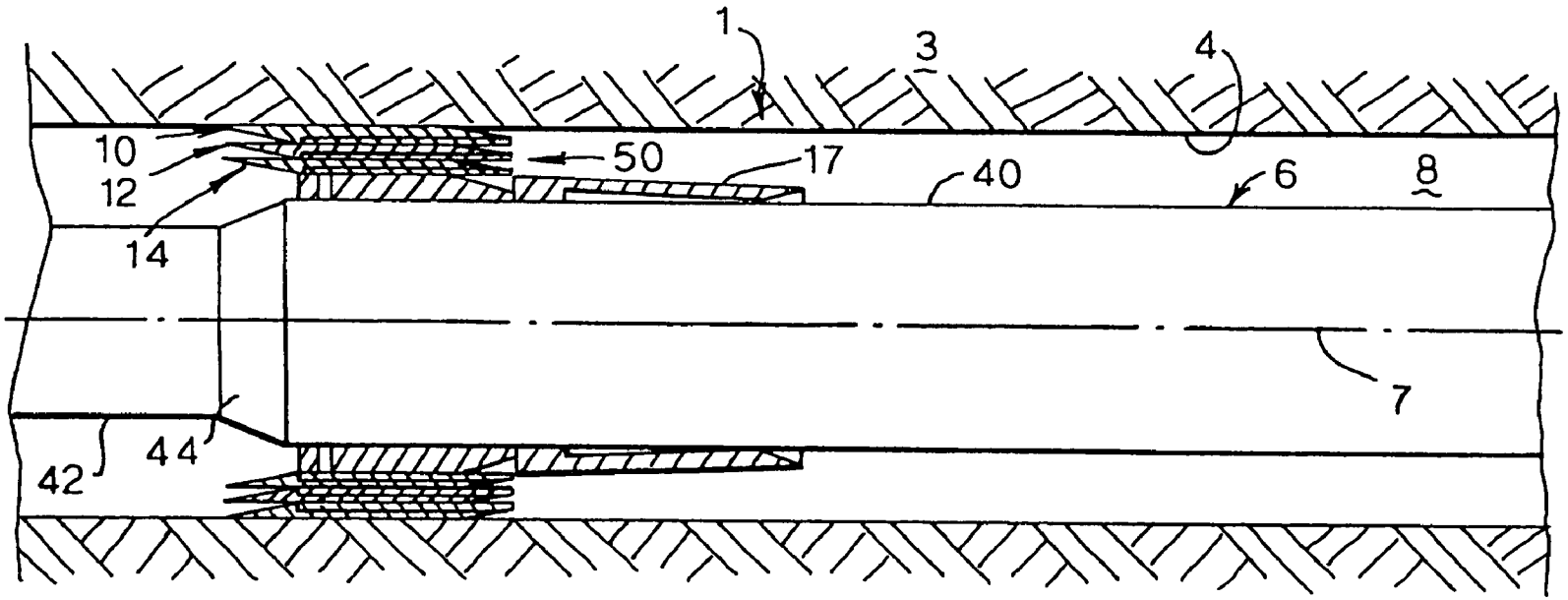

Referring further to FIG. 1C, movement of the expander is continued so that movement of the transition portion 44 is continued. Since the stopper 16 prevents any further axial movement of the compression sleeve 17 and the set 50 of radially stacked seal elements, continued movement of the transition portion 44 leads to radial expansion of the compression sleeve 17, the stopper 16 and the set 50 of radially stacked seal elements. The set 50 of radially stacked seal elements thereby becomes firmly compressed between the stopper 16 and the borehole wall 4 so as to form an annular seal there between.

In this manner it is achieved that an annular seal is created between the casing 6 and the borehole wall 1, whereby a relatively large annular space is initially present there between and whereby the individual components of the seal are relatively thin so that installation of the casing 6 in the borehole 1 is not hampered by the seal.

During normal operation of the second embodiment, the casing 6 is installed in the borehole 1 with the compression sleeve 17 and the injection device 51 arranged around it whereby injection device 51 is fixedly connected to the casing 6. Cement slurry is then pumped into the annular space 8, which slurry hardens upon contact with a selected chemical activator. The injection device 51 contains an amount of such chemical activator sufficient to induce hardening a portion of the cement slurry in-between the injection device and another injection device arranged at some axial distance. The expander is then pushed or pulled through the casing 6 to radially expand the casing 6 and thereby to form the initial expanded portion 40. As shown in FIG. 2B, the expander is moved through the casing 1 in the direction of injection device 51 thereby moving the transition portion 44 in the direction of the injection device 51. Upon contact of the transition portion 44 with the edge 46 of the compression sleeve 17, continued movement of the transition portion 44 induces the compression sleeve to move against the annular pump 52 of injection device 51. Thereby the pump 52 pumps the chemical activator via conduit 54 and the nozzles 56 into the body of cement slurry present in the annular space 8. As a result the portion of the cement slurry in-between the injection device and the other injection device hardens and thereby seals the annular space 8. Further movement of the expander past the injection device 51 causes the injection device 51 to be flattened due to its radial expansion. It is thus achieved that hardening of the cement occurs only at those portions of the cement slurry where the casing 6 has been successfully expanded. Should the expander become stuck in the casing 6, the unexpanded casing portion then can be retrieved to surface. Alternatively the remainder of the cement can be of a composition such that the cement will set after a prolonged period of time (i.e. in the order of days) and therefore will result into a conventionally cemented annulus.

During normal operation of the third embodiment, the casing 6 is installed in the borehole 1 with the compression sleeve 17 and the casing centraliser 60 provided around the casing 6. The expander is then pushed or pulled through the casing 6 in the direction of centraliser 60 so as to radially expand the casing 6 and thereby to form the initial expanded portion 40. As shown in FIG. 3B, continued movement of the transition portion 44 causes the compression sleeve 17 to move against the centraliser 60 and thereby to move end part 66 in the direction of end part 64. As a result the centraliser is compressed so that the spring arms 62 become radially expanded against the borehole wall. As shown in FIG. 3C, further movement of the expander past the compression sleeve 17 and the centraliser 60 causes the end parts 64, 66 of centraliser 60 to be radially expanded. Thereby the spring arms 62 become even more compressed against the borehole wall and thus the casing 6 becomes adequately centralised in the borehole 1.

During normal operation of the fourth embodiment, the casing 6 is installed in the borehole 1 with the compression sleeve 17 and the slideable sleeve 70 provided around the casing 6 whereby the openings 72 are uncovered. The openings 72 are used to pump cement from the interior of the casing 6 into the annular space 8 (which is a conventional operation).

Thereafter the expander is pushed or pulled through the casing 6 in the direction of sleeve 70 so as to radially expand the casing 6 and thereby to form the initial expanded portion 40. As shown in FIG. 4B, continued movement of the transition portion 44 causes the compression sleeve 17 to move against the sleeve 70 and thereby causes the sleeve 70 to slide over the casing portion with the openings 72 and thereby to cover the openings 72. As shown in FIG. 4C, further movement of the expander past the slideable sleeve 70 causes the compression sleeve 17 and the slideable sleeve 70 to be radially expanded. In this manner it is achieved that the slideable sleeve 70 adequately covers the openings 72 and seals the interior of the casing 6 from the exterior thereof.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A method of activating a downhole system arranged in an annular space formed between a radially expandable tubular element extending into a borehole formed into an earth formation and a cylindrical wall surrounding the tubular element, the downhole system being arranged so as to be activated by movement of an annular movement device along the tubular element, the method comprising:

arranging said annular moving device around the tubular element, the moving device having an inner diameter slightly larger than the outer diameter of the tubular element in its unexpanded shape;

gradually expanding a portion of the tubular element by moving an expander through the tubular element in the direction of the moving device, whereby a transition zone of the tubular element is defined between the expanded and unexpanded portions of the tubular element and;

upon contact of the transition zone with the moving device, continuing movement of the expander through the tubular element so as to move the moving device in an axial direction along the tubular element whereby the moving device activates the downhole system.

2. The method of claim 1, wherein the cylindrical wall is the borehole wall and the downhole system includes a set of annular seal elements arranged in the annular space in a manner that the seal elements are mutually displaced in axial direction, and wherein during activation of the downhole system the seal elements axially move relative to each other in a manner that the seal elements become radially stacked so as to form a set of radially stacked seal elements which seals the annular space.

3. The method of claim 2, wherein for each pair of adjacent seal elements a first seal element of the pair is induced to slide along a radially outer or inner surface of a second seal element of the pair.

4. The method of claim 3, wherein the first seal element of each pair of adjacent seal elements is made of a flexible material, and wherein the first seal element is radially extended during sliding along said radially outer surface or radially compressed during sliding along said radially inner surface.

5. The method of claim 4, wherein the first seal element of each pair of adjacent seal elements is induced to slide along said radially outer surface of the second seal element of the pair.

6. The method of claim 3, wherein the first seal element of each pair of adjacent seal elements is induced to slide along said radially outer surface of the second seal element of the pair.

7. The method of claim 1, wherein the downhole system includes an annular injection device which, during activation thereof, injects a selected fluid into the annular space.

8. The method of claim 7, wherein the selected fluid includes one of a chemical activator for hardening a cement slurry present in the annular space, or a catalyst or a chemical for triggering a chemical reaction of a resin present in the annular space.

9. The method of claim 7, wherein the downhole system includes a plurality of said annular injection devices arranged at selected mutual axial spacings in the annular space, and whereby the injection devices are sequentially activated in correspondence with movement of the expander though the tubular element.

10. The method of claim 8, wherein the downhole system includes a plurality of said annular injection devices arranged at selected mutual axial spacings in the annular space, and whereby the injection devices are sequentially activated in correspondence with movement of the expander though the tubular element.

11. The method of claim 1, wherein the tubular element is a borehole casing, and wherein the downhole system is a casing centraliser having centraliser members which radially expand upon activation of the casing centraliser by the moving device.

12. The method of claim 11, wherein the centraliser members radially expand by bending of the centraliser members.

13. The method of claim 1, wherein the tubular element is provided with at least one opening providing fluid communication between the interior and the exterior of the tubular element, and wherein the downhole system includes a sleeve slideable between a first position in which the sleeve uncovers each opening and a second position in which the sleeve covers each opening.

* * * * *